US011094306B2

(12) United States Patent
Yamada

(10) Patent No.: US 11,094,306 B2
(45) Date of Patent: Aug. 17, 2021

(54) SOUND CONTROL DEVICE, CONTROL METHOD AND PROGRAM THEREOF

(71) Applicant: Yamaha Corporation, Hamamatsu (JP)

(72) Inventor: Yuji Yamada, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 16/738,126

(22) Filed: Jan. 9, 2020

(65) Prior Publication Data

US 2020/0227014 A1 Jul. 16, 2020

(30) Foreign Application Priority Data

Jan. 10, 2019 (JP) ..... JP2019-002973

(51) Int. Cl.
*G10H 1/00* (2006.01)

(52) U.S. Cl.
CPC ..... *G10H 1/0066* (2013.01); *G10H 1/0008* (2013.01)

(58) Field of Classification Search
CPC ..... G10H 1/0066; G10H 1/0008
USPC ..... 84/645
See application file for complete search history.

(56) References Cited

U.S. PATENT DOCUMENTS 5,270,475 A * 12/1993 Weiss ..... G10H 1/0008 84/454
5,296,641 A * 3/1994 Stelzel ..... G10H 1/0008 250/338.1
5,361,673 A * 11/1994 Kira ..... G10H 1/0066 84/615
5,471,008 A * 11/1995 Fujita ..... G10H 1/0066 84/477 R
5,834,671 A * 11/1998 Phoenix ..... G10H 3/182 84/645
6,611,537 B1 * 8/2003 Edens ..... H04L 12/2803 348/E7.05
6,686,530 B2 * 2/2004 Juszkiewicz ..... G10H 1/0058 369/4
7,786,371 B1 * 8/2010 Moates ..... G10H 1/368 84/645

(Continued)

FOREIGN PATENT DOCUMENTS

JP 7-36456 A 2/1995

*Primary Examiner* — Christina M Schreiber
(74) *Attorney, Agent, or Firm* — Crowell & Moring LLP

(57) ABSTRACT

A sound control device includes a plurality of setting interfaces. Each of the setting interfaces includes a parameter operator, a communication interface performing control change message transmission and reception, a generation unit generating the control change message, a designation unit designating validity or invalidity of generating respective sound signals for the plurality of setting interfaces, a mode selection unit selecting a control mode of the communication interface, and a control unit. The control unit controls such that, when a first mode is selected, the control change message generated by the generation unit for a setting interface which is designated as valid among the plurality of setting interfaces is not transmitted through the communication interface, and the control change message generated by the generation unit for a setting interface which is designated as invalid among the plurality of setting interfaces is transmitted through the communication interface.

18 Claims, 7 Drawing Sheets

(56) References Cited

U.S. PATENT DOCUMENTS

| | | | | |
|---|---|---|---|---|
| 2003/0200859 | A1* | 10/2003 | Futamase | G10H 1/365 84/622 |
| 2007/0124150 | A1* | 5/2007 | Sinai | H03M 1/66 704/500 |
| 2007/0131098 | A1* | 6/2007 | Moffatt | G10H 1/40 84/645 |
| 2009/0145287 | A1* | 6/2009 | Okano | G10H 1/34 84/645 |
| 2010/0083814 | A1* | 4/2010 | Kira | G10H 1/24 84/622 |
| 2010/0180755 | A1* | 7/2010 | Copeland | G10H 3/146 84/622 |
| 2011/0174138 | A1* | 7/2011 | Loh | G10H 1/0066 84/645 |
| 2017/0004811 | A1* | 1/2017 | Yamada | G10H 1/043 |
| 2020/0227014 | A1* | 7/2020 | Yamada | G10H 1/22 |
| 2020/0227016 | A1* | 7/2020 | Yamada | G10B 3/12 |

* cited by examiner

FIG.6

| MODE / DESIGNATION OF SETTING UNIT | ON | OFF | Invert |
|---|---|---|---|
| VALID | TRANSMIT AND RECEIVE | NOT TRANSMIT OR RECEIVE | NOT TRANSMIT OR RECEIVE |
| INVALID | NOT TRANSMIT OR RECEIVE | NOT TRANSMIT OR RECEIVE | TRANSMIT AND RECEIVE |

SOUND CONTROL DEVICE, CONTROL METHOD AND PROGRAM THEREOF

CROSS REFERENCE TO RELATED APPLICATION

This application is based upon and claims the benefit of priority of Japanese Patent Application No. 2019-2973 filed on Jan. 10, 2019, the contents of which are incorporated herein by reference in its entirety.

BACKGROUND OF THE INVENTION

1. Field of the Invention

The embodiments of the present invention relate to a sound control device including a plurality of setting units configured to set sound parameters, a control method and a program thereof.

2. Description of the Related Art

In related art, in order to improve performance, it is desired to realize simultaneous sound production (layered sound production) of a plurality of timbres using an internal sound source and an external sound source in a sound control device such as an electronic musical instrument. Patent Literature 1, JP-A-7-36456 referred discloses an electronic musical instrument in which whether MIDI data generated in response to a keyboard operation is to be transmitted to the outside is set independently for each key region to which operated keys belong.

Patent Literature 1: JP-A-7-36456

SUMMARY OF THE INVENTION

However, in Patent Literature 1, the flags must be set in advance. For this reason, it is difficult to change sound parameters related to an external sound source freely in a live hall, thus operability thereof is low. If a setting unit configured to set the sound parameters is provided exclusively for the external sound source separately from an internal sound source, a configuration is made more complicated and a cost thereof is also increased.

A sound control device, in which the number of setting units configured to set sound parameters for timbres is the same as the number of the timbres, is also known. In such a sound control device, a timbre which is an object of layered sound production can be set as "valid" and a timbre which is not the object of the layered sound production can be set as "invalid". A setting unit corresponding to the timbre which is set as invalid is not used. That is, even if an operator belonging to the setting unit corresponding to the timbre which is set as invalid is operated, the operation is not reflected in sound control. Therefore, operators included in setting units are not effectively used.

One object of the present invention is to provide a sound control device having improved operability, in which operators can be effectively used, a method for controlling the same, and a program.

An aspect of the present invention provides a sound control device, including: a plurality of setting interfaces, each including a parameter operator configured to set a sound parameter corresponding to a set timbre; a communication interface configured to perform message transmission and reception with an external MIDI sound source, the message being a control change message of an MIDI standard; a generation task configured to generate the control change message in response to an operation on the parameter operators of the plurality of setting interfaces; a designator configured to designate validity or invalidity of generating respective sound signals by an internal sound source for the plurality of setting interfaces; a mode selector configured to select one of a plurality of control modes of the communication interface; and a controller configured to control such that, when a first mode is selected by the mode selector: the control change message generated by the generator for a setting interface which is designated as valid among the plurality of setting interfaces is not transmitted through the communication interface; and the control change message generated by the generator for a setting interface which is designated as invalid among the plurality of setting interfaces is transmitted through the communication interface.

According to an aspect of the present invention, the operability can be improved and the operators can be effectively used.

BRIEF DESCRIPTION OF THE DRAWINGS

In the accompanying drawings:

FIG. 6 is a conceptual diagram showing an aspect of transmission and reception control of a CC message according to a control mode;

DETAILED DESCRIPTION OF THE EXEMPLARY EMBODIMENTS

An embodiment of the present invention will be described below with reference to drawings.

Figure 1:
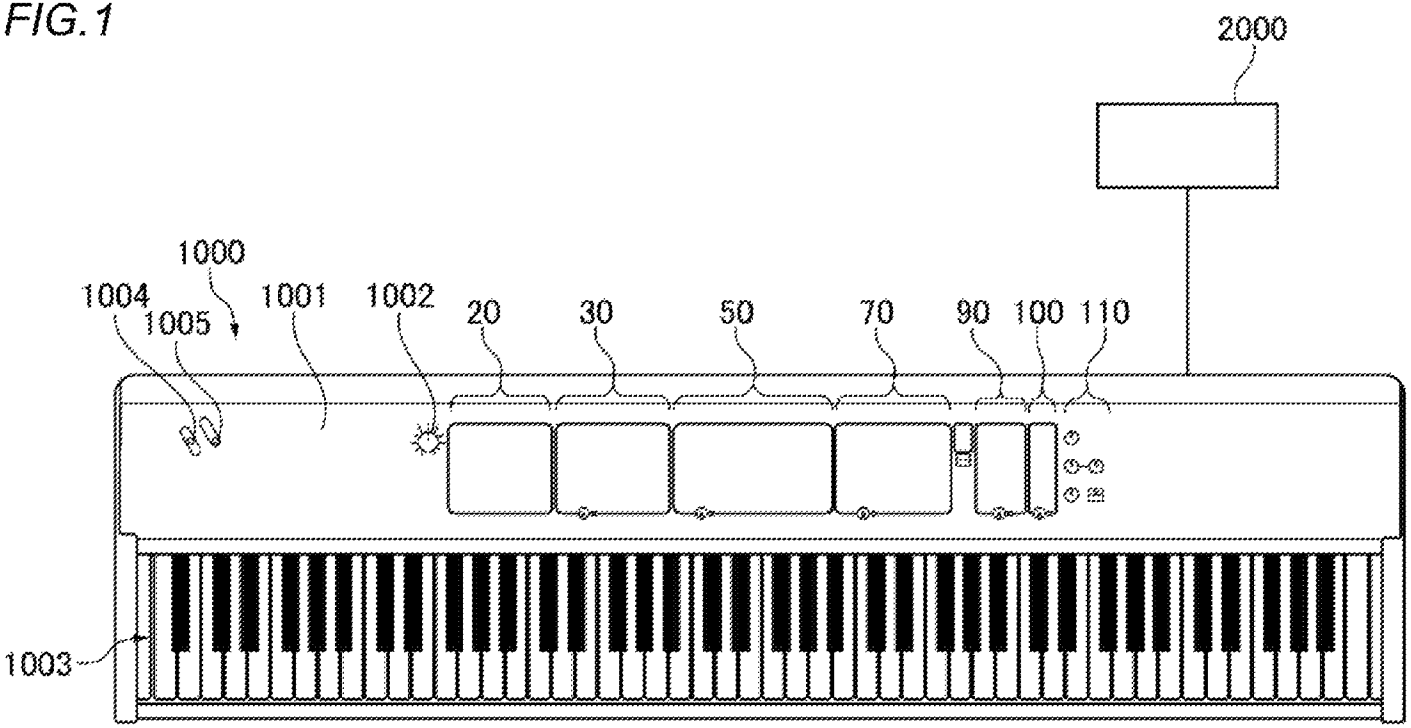
FIG. 1 is a configuration diagram of a sound control system including a sound control device.

FIG. 1 is a configuration diagram of a sound control system including a sound control device according to an embodiment of the present invention. The sound control system includes a keyboard device 1000 serving as the sound control device and an external device 2000, which are communicably connected to each other. The keyboard device 1000 is configured as an electronic keyboard instrument, for example. The keyboard device 1000 includes a keyboard unit 1003 including a plurality of keys. A master volume knob 1002, a pitch bend lever 1004, and a modulation lever 1005 are placed on a panel surface 1001 of the keyboard device 1000. The panel surface 1001 further includes a plurality of sections configured to receive various operations and settings. These sections include a main section 20, a first timbre section 30, a second timbre section 50, a third timbre section 70, a delay section 90, a reverb section 100, and a master equalizer (EQ) section 110.

Figure 2:
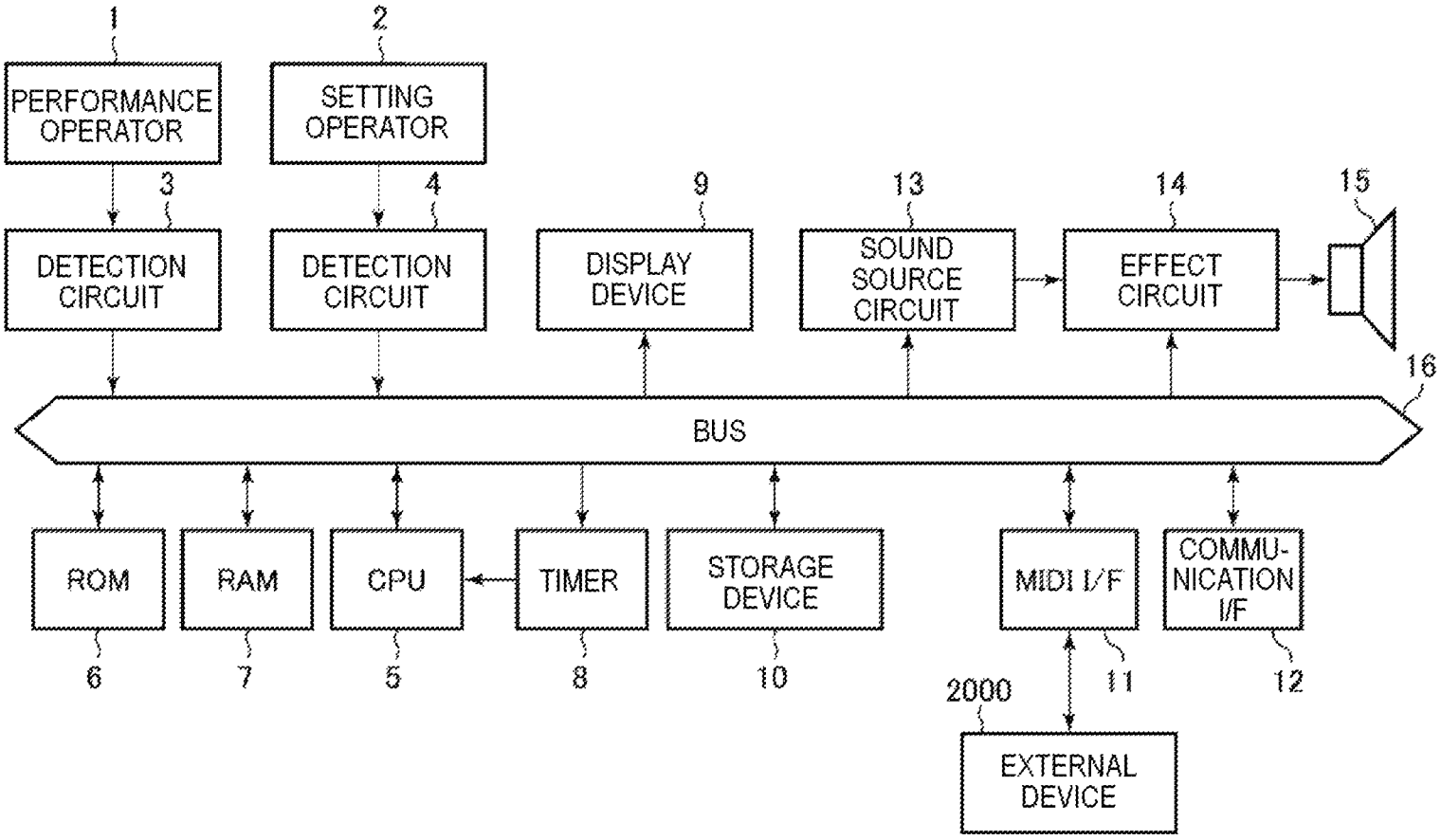
FIG. 2 is a block diagram showing an overall configuration of a keyboard device.

FIG. 2 is a block diagram showing an overall configuration of the keyboard device 1000. The keyboard device 1000 includes a detection circuit 3, a detection circuit 4, a ROM 6, a RAM 7, a timer 8, a display device 9, a storage device 10, and a musical instrument digital interface (MIDI) interface (MIDI I/F) 11. The keyboard device 1000 further includes a communication interface (communication I/F) 12, a sound source circuit 13, and an effect circuit 14. Components 3, 4, and 6 to 14 are connected to a CPU 5 via a bus 16.

A performance operator 1 configured to input pitch information is connected to the detection circuit 3. The performance operator 1 includes the keyboard unit 1003, the master volume knob 1002, the pitch bend lever 1004, and the modulation lever 1005 (FIG. 1). A setting operator 2 including a plurality of switches configured to input various types of information is connected to the detection circuit 4. The setting operator 2 includes a plurality of operators (described below with reference to FIGS. 2 and 3) included in each of the sections 20, 30, 50, 70, 90, 100, and 110. The display device 9 is configured by a liquid crystal display (LCD) or the like, and displays various types of information. The timer 8 is connected to the CPU 5. The external device 2000 can be connected to the MIDI I/F 11. The external device 2000 includes an external MIDI sound source. A server computer or the like can be connected to the communication I/F 12 via a communication network (not shown). A sound system 15 is connected to the sound source circuit 13 via the effect circuit 14. The sound system 15 may be incorporated in the keyboard device 1000 or may be connected to the keyboard device 1000 as an external device.

The detection circuit 3 detects an operation state of the performance operator 1. The detection circuit 4 detects an operation state of the setting operator 2. The CPU 5 controls the entire device. The ROM 6 stores a control program executed by the CPU 5, various table data, and the like. The RAM 7 temporarily stores various input information such as performance data and text data, various flags or buffer data, and arithmetic results. The timer 8 measures an interrupt time in timer interrupt processing, and various times. The storage device 10 stores various application programs including the control program, performance information, various data, and the like. The storage device 10 includes a nonvolatile storage medium. The storage device 10 may be an incorporated storage device or an external storage device. The storage device 10 is, for example, a semiconductor memory, a flexible disk drive (FDD), a hard disk drive (HDD), a CD-ROM drive or a magneto-optical disk (MO) drive.

The MIDI I/F 11 inputs an MIDI signal from the external device 2000 or outputs the MIDI signal to the external device 2000. A MIDI message can be transmitted and received by connecting MIDI terminals of the keyboard device 1000 and the external device 2000 with each other via a MIDI cable. The MIDI message to be transmitted and received at least includes a control change message.

The sound source circuit 13 converts performance data input from the performance operator 1 or preset performance data (such as automatic performance data stored in the storage device 10) into a sound signal. The effect circuit 14 applies various effects to the sound signal input from the sound source circuit 13. The sound system 15, such as a digital-to-analog converter (DAC), an amplifier, or a speaker, converts the sound signal input from the effect circuit 14 into a sound. When a performance is performed using a performance described below, the CPU 5 uses the effect circuit 14 to apply an effect to a sound signal based on an effect setting defined in the performance.

Figure 3:
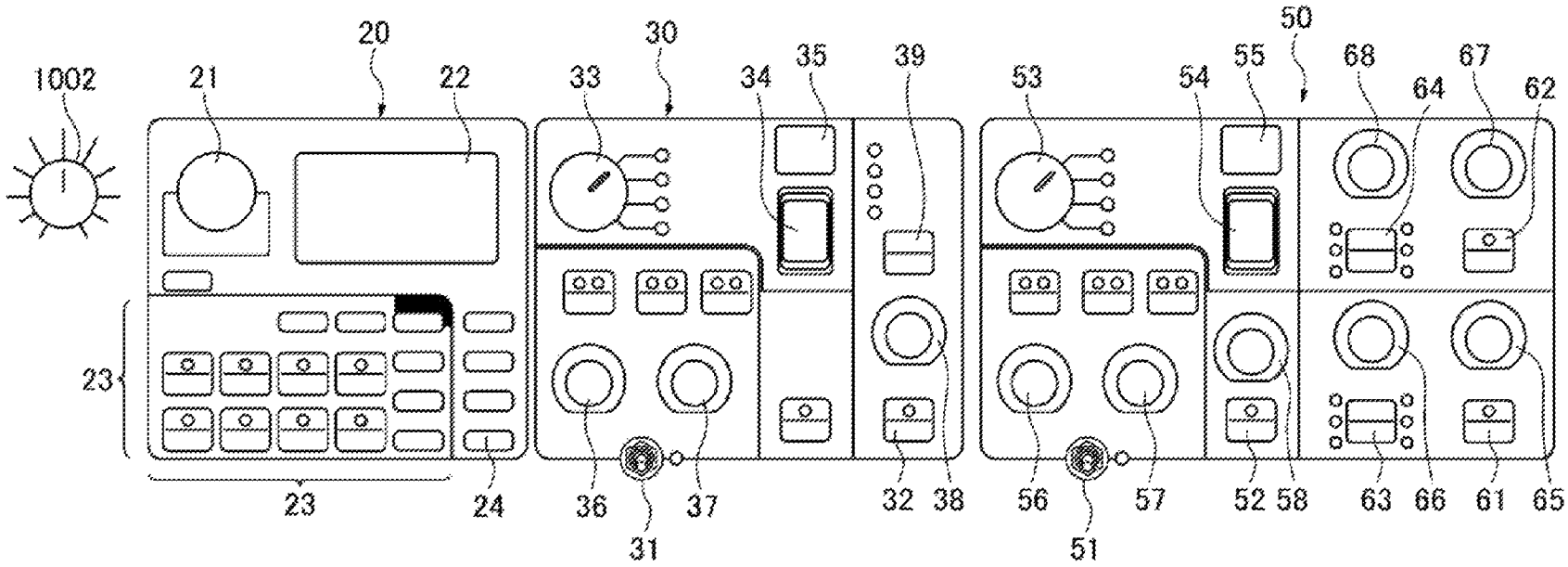
FIG. 3 shows main components placed on a panel surface of the keyboard device.
Figure 4:
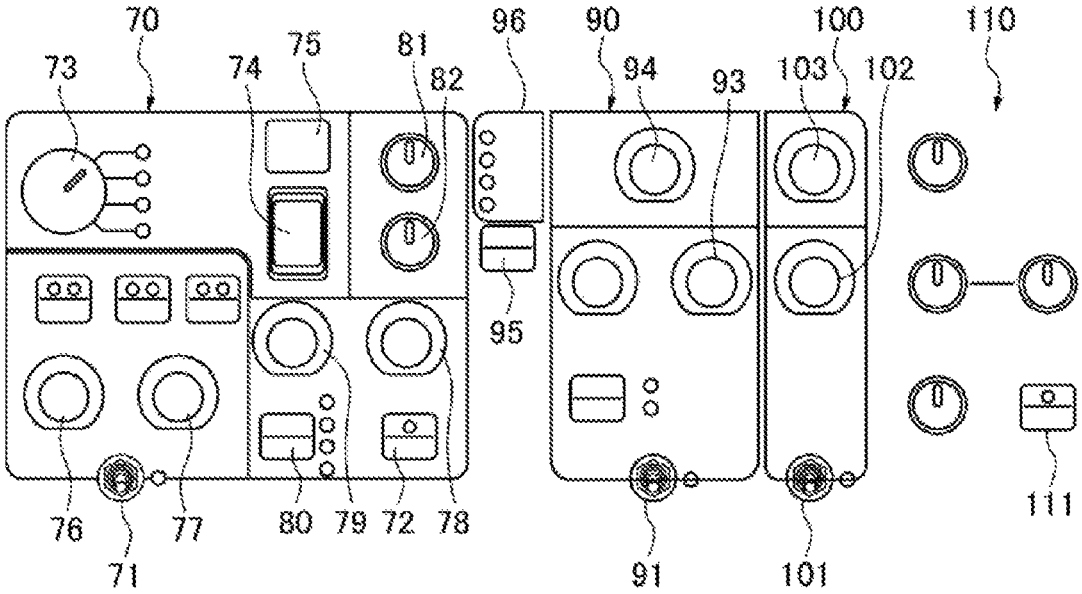
FIG. 4 shows main components placed on the panel surface of the keyboard device.

Next, configurations and functions of each section placed on the panel surface 1001 of the keyboard device 1000 will be described with reference to FIGS. 3 and 4. FIGS. 3 and 4 show main components placed on the panel surface 1001 of the keyboard device 1000.

The performance refers to information (setting information) including at least one timbre group and one effect setting group. At least one timbre and at least one effect setting belong to one performance. A plurality of performances are stored in advance (preset) in the ROM 6 or the storage device 10. A performer (hereinafter, also referred to as a user) can edit the stored performances and store the edited performances in the storage device 10 serving as a holding unit (a holder) so as to override the stored performances. The performer can also create a new performance and store the new performance in the storage device 10 serving as the holding unit so as to add the performance.

The effect setting refers to information related to types of effect and modes of application. The effect setting is set with respect to the included timbre for each performance. The effect setting includes settings of effect (such as an insertion effect), reverb, delay, and EQ. Effects to be set included as the effect setting are not limited to be plural as described above, and may be at least one effect. Types thereof are not limited to the above four types, and may be any type as long as the effect is applied to the timbre. For example, the effect setting may only include settings of reverb, delay, and EQ.

The main section 20 shown in FIG. 3 is used to make various settings in cooperation with other sections. The first timbre section 30, the second timbre section 50, and the third timbre section 70 shown in FIG. 4 are used to make settings for each timbre used for producing a sound. As an example, the first timbre section 30 is a piano section and is mainly used for setting timbres of acoustic pianos. The second timbre section 50 is an electric piano section and is mainly used for setting timbres of electric pianos. The third timbre section 70 is a subsection, and is mainly used for setting a timbre to be layered on a piano or an electric piano. The delay section 90, the reverb section 100, and the master EQ section 110 are effect sections configured to set an effect that is commonly applied to timbres to be produced (hereinafter, referred to as a common effect). In addition to the common effect, an insertion effect is also provided as an effect that can be specifically applied to each timbre section. The insertion effect is a type of effect that is specifically designed for each timbre section, and selection of the insertion effect in each timbre section will be described below.

As shown in FIG. 3, the main section 20 includes a dial 21, a main display 22, a selection switch group 23, and a menu button 24. The menu button 24 is used for displaying a screen configured to make setting for the entire system. When the dial 21 is rotated, an item is selected, and when the dial 21 is pressed, edited contents are determined. A setting screen is displayed on the main display 22, for example, the selected item or the edited contents are displayed. The selection switch group 23 includes a plurality of push buttons. The plurality of push buttons are used, for example, to invoke one of a plurality of registered performances.

The first timbre section 30 includes a timbre section ON/OFF switch 31, an insertion effect ON/OFF switch 32, a category selector 33, a timbre select switch 34, and a display 35. The first timbre section 30 further includes a volume knob 36, a tone knob 37, a depth knob 38, and an insertion effect switching switch 39.

The category selector 33 is a rotation operator configured to select a timbre category. The timbre select switch 34 is a switch configured to select one timbre from a timbre group belonging to the selected timbre category. The timbre section ON/OFF switch 31 is a switch configured to designate validity/invalidity of a timbre. When the validity of the timbre is designated, the timbre is to be produced. For example, in response to a performance of the keyboard section 1003, a sound of the timbre is produced. On the contrary, if the invalidity of the timbre is designated, the timbre is not produced. The timbre section ON/OFF switch 31 is, for example, a toggle switch operated by pressing or inclining. For example, when an operation ends, the timbre section ON/OFF switch 31 is returned to an original posture. On the display 35, a number indicating the currently selected timbre or the like is displayed.

The insertion effect switching switch 39 is a switch configured to switch the insertion effect to be applied to the timbre set in the first timbre section 30. As for the insertion effect mentioned here, a plurality of types are prepared, such as stereo compressor and distortion. The performer selects one insertion effect to be applied by operating the insertion effect switching switch 39. The insertion effect ON/OFF switch 32 is a switch configured to designate validity/invalidity of application of the insertion effect selected by the insertion effect change switch 39. Only when the application of the insertion effect is designated to be valid, the selected insertion effect is applied to the timbre set in the first timbre section 30.

The volume knob 36 is a rotation operator configured to adjust volume of the timbre. The tone knob 37 is a rotation operator configured to adjust a tone of the timbre. The depth knob 38 is a rotation operator configured to adjust a depth to which the insertion effect is applied.

The second timbre section 50 includes a timbre section ON/OFF switch 51, an insertion effect ON/OFF switch 52, a category selector 53, a timbre select switch 54, and a display 55. The second timbre section 50 further includes a volume knob 56, a tone knob 57, and a drive knob 58. The second timbre section 50 further includes insertion effect ON/OFF switches 61, 62, insertion effect switching switches 63, 64, a speed knob 65, a depth knob 66, a rate knob 67 and a depth knob 68.

Configurations and functions of the switches 51, 52, 54, the category selector 53, the display 55, and the knobs 56, 57 are the same as configurations and functions of the switches 31, 32, 34, the category selector 33, the display 35, and the knobs 36, 37. Configurations and functions of the switches 61, 62 are the same as a configuration and a function of the switch 32. Configurations and functions of the switches 63, 64 are the same as a configuration and a function of the switch 39.

The insertion effect ON/OFF switches 61, 62 are switches configured to designate validity/invalidity of application of insertion effects set by the insertion effect switching switches 63, 64 with respect to a timbre set in the second timbre section 50. An insertion effect, such as chorus or flanger, can be switched by the insertion effect switching switch 63. An insertion effect, such as auto panning or tremolo, can be switched by the insertion effect switching switch 64.

Configurations and functions of the depth knobs 66, 68 are the same as a configuration and a function of the depth knob 38. The speed knob 65 is a rotation operator configured to adjust a speed of the insertion effect. The rate knob 67 is a rotation operator configured to adjust the speed of the insertion effect.

As shown in FIG. 4, the third timbre section 70 includes a timbre section ON/OFF switch 71, an insertion effect ON/OFF switch 72, a category selector 73, a timbre select switch 74, and a display 75. The third timbre section 70 further includes a volume knob 76, a tone knob 77, a speed knob 78, a depth knob 79, an insertion effect switching switch 80, an attack knob 81, and a release knob 82.

Configurations and functions of the switches 71, 72, 74, 80, the category selector 73, the display 75, and the knobs 76, 77 are the same as configurations and functions of the switches 31, 32, 34, 39, the category selector 33, the display 35, and the knobs 36, 37. The insertion effect ON/OFF switch 72 is a switch configured to designate validity/invalidity of application of an insertion effect set by the insertion effect switching switch 80 with respect to a timbre set in the third timbre section 70. An insertion effect, such as chorus or rotary speaker, can be switched by the insertion effect switching switch 80.

A configuration and a function of the depth knob 79 are the same as the configuration and the function of the depth knob 38. A configuration and a function of the speed knob 78 are the same as a configuration and a function of the speed knob 65. The attack knob 81 is a rotation operator configured to adjust a time for a sound to start. The release knob 82 is a rotation operator configured to adjust a time for a sound to disappear.

An effect level switching button 95 and a lamp unit 96 are placed between the third timbre section 70 and the delay section 90. The effect level switching button 95 is a switch configured to select an effect whose send level is to be adjusted among delay and reverb. The lamp unit 96 includes three section lamps. A section lamp corresponding to a timbre section set as a target of the send level adjustment is lighted by the effect level switching button 95.

The delay section 90 includes a delay ON/OFF switch 91, a time knob 93, and a depth knob 94. The reverb section 100 includes a reverb ON/OFF switch 101, a time knob 102, and a depth knob 103. The ON/OFF switches 91, 101 are switches configured to switch whether to apply a delay effect or a reverb effect to a timbre corresponding to a valid timbre section among the timbre sections 30, 50, 70 (a timbre to be produced). In other words, the ON/OFF switches 91, 101 are designation operators configured to receive designation of validity/invalidity of a common effect (reverb, delay) defined in the selected performance.

The time knob 93 is a rotation operator configured to adjust a length of a feedback delay. The depth knob 94 is a rotation operator configured to adjust a depth to which a delay effect is applied. The time knob 102 is a rotation operator configured to adjust a length during which a reverb effect is applied. The depth knob 103 is a rotation operator configured to adjust a depth to which the reverb effect is applied.

A master EQ ON/OFF switch 111 of the master EQ section 110 is a switch configured to switch whether to apply a master EQ to the timbre corresponding to the valid timbre section among the timbre sections 30, 50, 70. By applying the master EQ, sound quality of an entire sound is corrected.

The volume set for each timbre section, the speed, length, depth of the insertion effect set for each timbre section are sound parameters set for the timbre corresponding to the timbre section. As described above, the target whose send level is to be adjusted can be switched by the effect level switching button 95. Therefore, the performer operates the knobs 93, 94, 102, 103 in a state where the section lamp corresponding to the timbre section whose send level is to be adjusted is lighted in the lamp unit 96. With such an operation, the sound parameters can be adjusted for each timbre section.

Next, operation examples at the time of invoking a performance, editing a performance, and adding a new performance will be described. The user selects one desired performance among a plurality of registered performances by operating the selection switch group 23 (FIG. 3). Then a name of the selected one performance is displayed on the main display 22. A performance of a selected state in an initial state, such as when the keyboard device 1000 is powered on, is determined in advance. When the user selects another performance by operating the selection switch group 23 while one performance is selected, the name of the newly selected performance is displayed on the main display 22 instead of the name displayed so far. In this way, the selected performance is switched by the operation of the selection switch group 23.

When editing the selected performance, the user can switch validity/invalidity for each timbre section, for example, by operating the timbre section ON/OFF switches 31, 51, or 71. The user can set a corresponding timbre for each timbre section by operating the category selectors 33, 53 or 73 and the timbre select switches 34, 54, or 74. Further, the user can set an insertion effect to be applied to each timbre section by operating the insertion effect switching switches 39, 63, 64, or 80. The user can switch validity/invalidity of the insertion effect for each timbre section by operating the insertion effect ON/OFF switches 32, 52, or 72. Further, the user can adjust sound parameters related to the volume and the insertion effect by appropriately operating the knobs 36 to 38, 56 to 58, 65 to 68, and 76 to 79.

The performance is reflected in a sound produced during performance even if the performance is being edited without being saved. In order to save the performance after editing, the user operates a store switch of the selection switch group 23. With this operation, a timbre section edited currently is saved. An update can be performed by overriding when the edited timbre section is stored and registered. A new timbre section having another name can be additionally registered. A function of a creating unit (a creator) configured to create the new timbre section based on an operation of the user is mainly realized by cooperation of the setting operator 2, the CPU 5, the ROM 6, the RAM 7, and the storage device 10. The setting of the master EQ may be included in the performance, or may not be included therein.

As an example, it is assumed that the performance is desired to be set to produce a layered sound including a sound in which a stereo compressor is added to a first grand piano sound and a sound in which no insertion effect is added to a first electric piano sound. Moreover, it is desired to apply a reverb without applying a delay to the timbre of the sound to be produced. In this case, the user makes a setting as follows.

First, the user sets the first grand piano sound as the timbre of the first timbre section 30, and sets the first electric piano sound as the timbre of the second timbre section 50. The user turns on the switches 31, 51 of the timbre sections 30, 50, and turns off the switch 71 of the third timbre section 70. The user turns on the insertion effect switching switch 39 and turns off the insertion effect ON/OFF switches 61, 62. The user turns off the delay ON/OFF switch 91 and turns on the reverb ON/OFF switch 101. In addition, the user appropriately operates the knobs or the rotation operators so as to adjust the sound parameters.

Figure 5:
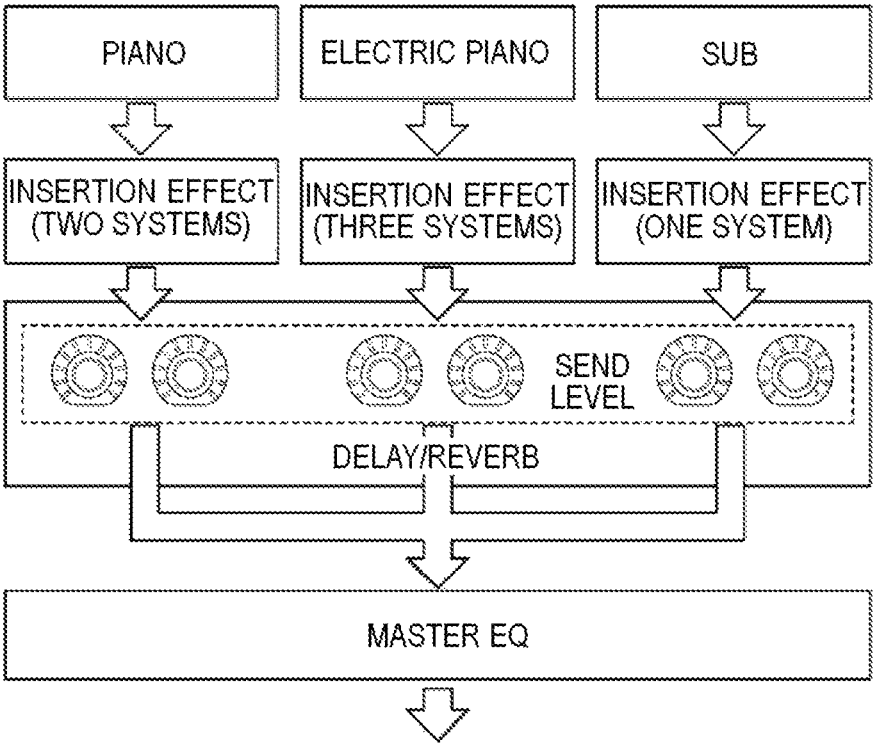
FIG. 5 is a conceptual diagram showing a flow of signals sent from each timbre section to a master EQ section.

FIG. 5 is a conceptual diagram showing a flow of signals sent from each timbre section to the master EQ section 110. The sound signals of the timbre corresponding to each timbre section are supplied to the effect section after unique insertion effects are applied to each timbre section. Then, a common effect corresponding to a set send level is applied to all of the signals supplied from each timbre section to the effect section. The signals to which the common effect is applied are output after EQ is applied thereto by the master EQ section 110.

As for sound production using the sound source circuit 13 and the effect circuit 14, the sound signal generation unit generates a sound signal based on performance information and a selected performance. A function of the sound signal generation unit is realized mainly by cooperation of the CPU 5, the sound source circuit 13, and the effect circuit 14. The performance information is input by the performance operator 1, for example. The performance information may also be acquired from the storage device 10 or acquired via the MIDI I/F 11. The sound signal generation unit generates a sound signal having a timbre defined in the performance and a pitch based on the performance information. The sound signal generation unit further applies an effect defined in the performance to the generated sound signal. The sound signal to which the effect is applied is converted into a sound by the sound system 15 so as to generate the sound.

So far, only the sound production of an internal sound source (the sound source circuit 13) is described with focus. Next, processing for performing layered sound production using both the internal sound source and an external sound source (the external device 2000) will be described. This layered sound production is hereinafter referred to as "layered sound production by parallel use of external sound source".

First, a control change message (hereinafter abbreviated as CC message) of an MIDI standard is generated in response to an operation of a parameter operator, which is an operator configured to set a sound parameter for the timbre corresponding to each timbre section. Here, the knobs 36 to 38, 56 to 58, 65 to 68 and 76 to 79 included in each timbre section correspond to the parameter operator. The sound parameter to be set in the present invention may include at least one of volume and effect. In the layered sound production by parallel use of external sound source, the generated CC message is transmitted to the external device 2000 through the MIDI I/F 11. The CC message output from the external device 2000 may be received by the keyboard device 1000 through the MIDI I/F 11.

FIG. 6 is a conceptual diagram showing an aspect of transmission and reception control of the CC message according to a control mode. In the present embodiment, there are three control modes regarding the communication: an Invert mode (first mode), an ON mode (second mode), and an OFF mode (third mode). Whether the CC message is transmitted and received is determined by a combination of the control mode and validity/invalidity designation of each timbre section. In a case of a combination of "transmission and reception" as shown in FIG. 6, it is determined that the CC message is transmitted and received.

The ON mode is a mode in which the CC message generated for a timbre section designated as valid is transmitted to the external device 2000 through the MIDI I/F 11, and the CC message generated for a timbre section designated as invalid is not transmitted to the external device 2000 through the MIDI I/F 11. The OFF mode is a mode in which any CC message generated in response to the operation of the parameter operator in each timbre section is not transmitted to the external device 2000 through the MIDI I/F 11 regardless of the valid/invalid designation of each timbre section.

The Invert mode is a mode in which the CC message generated for the timbre section designated as valid is not transmitted to the external device 2000 through the MIDI I/F 11, and the CC message generated for the timbre section designated as invalid is transmitted to the external device 2000 through the MIDI I/F 11.

As for reception of the CC message from the external device 2000, in the ON mode, the CC message corresponding to the timbre section designated as valid is received from the external device 2000 through the MIDI I/F 11, and the CC message corresponding to the timbre section designated as invalid is not received from the external device 2000 through the MIDI I/F 11. In the OFF mode, the CC message from the external device 2000 is not received regardless of the valid/invalid designation of each timbre section. In the Invert mode, the CC message corresponding to the timbre section designated as valid is not received from the external device 2000 through the MIDI I/F 11, and the CC message corresponding to the timbre section designated as invalid is received from the external device 2000 through the MIDI I/F 11.

Figure 7:
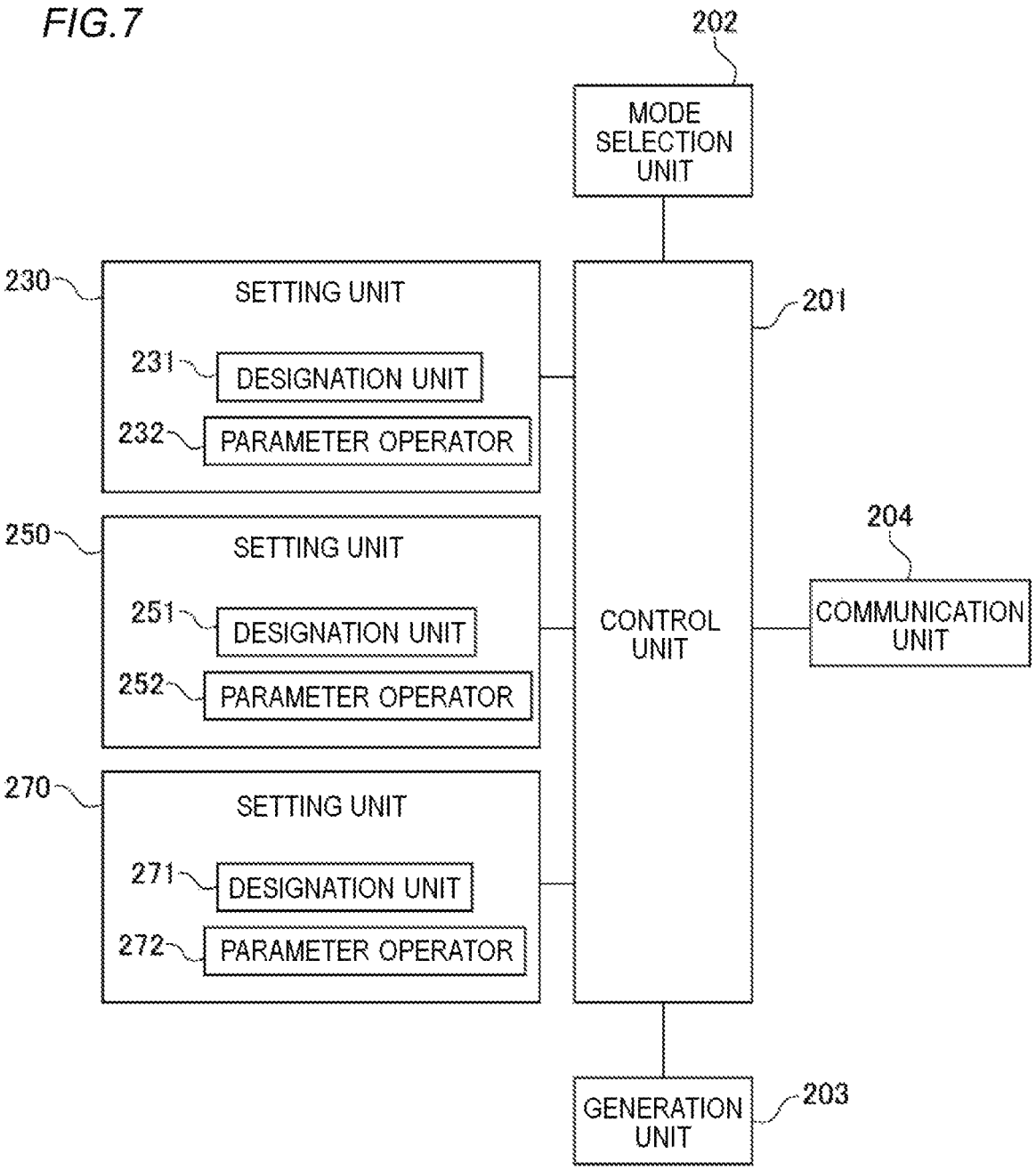
FIG. 7 is a block diagram of a functional configuration of the keyboard device.

FIG. 7 is a block diagram of a functional configuration of the keyboard device 1000. The keyboard device 1000 includes, as main functional blocks, a control unit (a controller) 201, a mode selection unit (a mode selector) 202, a generation unit (a generator) 203, a communication unit (a communication interface) 204, and setting units (setting interfaces) 230, 250, 270. A function of the control unit 201 is realized mainly by cooperation of the CPU 5, the ROM 6, the RAM 7, the timer 8, and the storage device 10. The MIDI I/F 11 corresponds to the communication unit 204. The communication unit 204 performs message transmission and reception of the CC message with the external device 2000.

The timbre sections 30, 50, and 70 (FIGS. 3 and 4) correspond to the setting units 230, 250, 270, respectively. The setting units 230, 250, 270 include designation units (designators) 231, 251, 271, respectively. The switches 31, 51, 71 correspond to the designation units 231, 251, 271, respectively. The setting units 230, 250, 270 include parameter operators 232, 252, 272, respectively. The knobs 36 to 38 (see FIG. 3) correspond to the parameter operator 232. The knobs 56 to 58 and 65 to 68 (see FIG. 3) correspond to the parameter operator 252. The knobs 76 to 79 (see FIG. 4) correspond to the parameter operator 272.

A function of the generation unit 203 is realized mainly by cooperation of the CPU 5, the ROM 6, and the RAM 7. The generation unit 203 generates the CC message in response to an operation performed on each of the parameter operators (232, 252, 272) of the plurality of setting units (230, 250, 270).

A function of the mode selection unit 202 is realized mainly by cooperation of the setting operator 2, the CPU 5, the ROM 6, the RAM 7, and the storage device 10. The mode selection unit 202 selects one of the three control modes of the communication unit 204 according to the operation of the user. Specifically, the mode selection unit 202 selects the control mode upon receiving an operation on the dial 21 and the menu button 24. For example, the performer can turn on the menu button 24 and press the dial 21 while a desired control mode is selected by rotating the dial 21, so as to determine the control mode.

When the performer operates the parameter operators 232, 252, 272 during the layered sound production by parallel use of external sound source, the CC message is generated in response to the operation. Then, the CC message corresponding to the setting unit determined for transmission and reception is transmitted to the external device 2000.

For example, a case where the setting unit 230 (the timbre section 30) is valid and the setting units 250, 270 (the timbre sections 50, 70) are invalid in the Invert mode is considered. As for production of the timbre corresponding to the timbre section 30, the CC message corresponding to an operation of the parameter operator 232 is reflected in generation of a sound signal by the sound source circuit 13 and the effect circuit 14, and is not transmitted to the external device 2000. Meanwhile, since the CC message corresponding to an operation of the parameter operator 252 or 272 is transmitted to the external device 2000, the CC message is reflected in the generation of the sound signal by the sound source circuit and the effect circuit included in the external device 2000. Therefore, in the Invert mode, the performer can use a parameter operator which is not used in the control of the internal sound source due to invalid designation to control the sound parameter of the external device 2000. In this way, the parameter operator can be effectively used.

Figure 8:
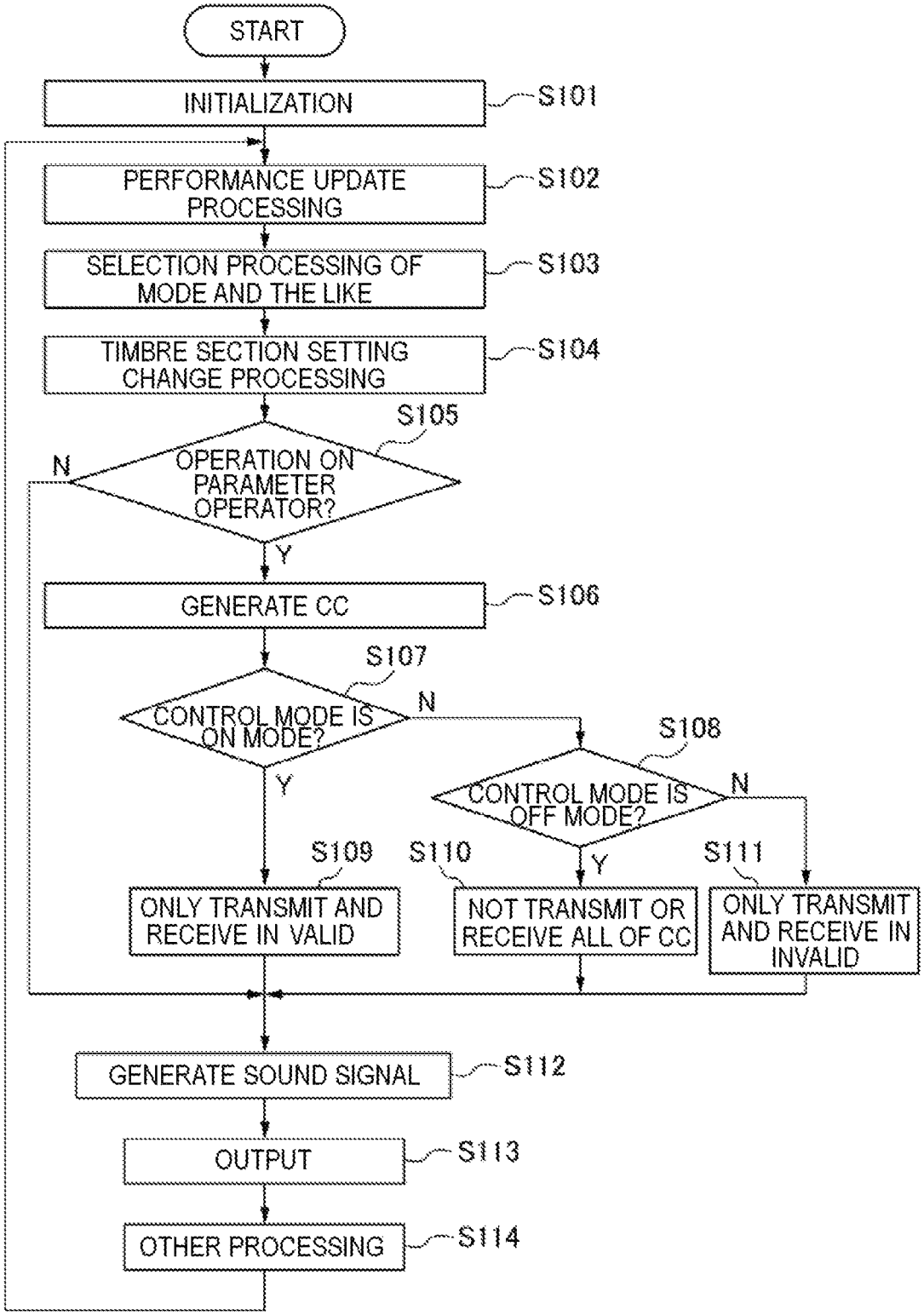
FIG. 8 is a flowchart of sound signal control processing.

FIG. 8 is a flowchart of sound signal control processing. The CPU 5 loads a program stored in the ROM 6 into the RAM 7 and executes the loaded program, so as to realize this processing. This processing is started when the keyboard device 1000 is powered on.

First, in step S101, the CPU 5 executes initialization processing. In this initialization processing, for example, the CPU 5 sets a default performance into a selected state. In step S102, if there is a user instruction such as edition, new addition, or deletion of a performance, the CPU 5 executes the processing in accordance with the instruction. In step S103, the CPU 5 executes control mode selection processing related to communication. For example, the CPU 5 selects one of the Invert mode, the ON mode, and the OFF mode upon receiving a user operation performed on the dial 21 and the menu button 24.

In step S104, the CPU 5 executes setting change processing of the timbre section. For example, the CPU 5 executes processing such as valid/invalid designation of each timbre section, setting of validity/invalidity of each effect based on the operation of the user. In step S105, the CPU 5 determines whether there is an operation performed on any one of the parameter operators 232, 252, 272. If there is no operation performed on any one of the parameter operators 232, 252, 272, the CPU 5 advances the processing to step S112. Meanwhile, if there is an operation performed on one of the parameter operators 232, 252, 272, the CPU 5 advances the processing to step S106.

In step S106, the CPU 5 generates a CC message in response to the operation performed on each of the parameter operators. In step S107, the CPU 5 determines whether the current control mode is the ON mode. If the current control mode is the ON mode, the CPU 5 advances the processing to step S109. However, if the current control mode is not the ON mode, the CPU 5 advances the processing to step S108 and determines whether the current control mode is the OFF mode. If the current control mode is the OFF mode, the CPU 5 advances the processing to step S110. However, if the current control mode is not the OFF mode, the CPU 5 can determine that the current control mode is the Invert mode, so that the CPU 5 advances the processing to step S111.

In step S109, the CPU 5 transmits the CC message generated for a timbre section designated as valid to the external device 2000 through the MIDI I/F 11. The CPU 5 does not transmit the CC message generated for a timbre section designated as invalid to the external device 2000 through the MIDI I/F 11. Further, if the CC message corresponding to the timbre section designated as valid is transmitted from the external device 2000, the CPU 5 receives the CC message. However, even if the CC message corresponding to the timbre section designated as invalid is transmitted from the external device 2000, the CPU 5 does not receive the CC message.

In step S111, the CPU 5 does not transmit the CC message generated for the timbre section designated as valid to the external device 2000 through the MIDI I/F 11. The CPU 5 transmits the CC message generated for the timbre section designated as invalid to the external device 2000 through the MIDI I/F 11. Further, even if the CC message corresponding to the timbre section designated as valid is transmitted from the external device 2000, the CPU 5 does not receive the CC message. However, if the CC message corresponding to the timbre section designated as invalid is transmitted from the external device 2000, the CPU 5 receives the CC message.

After the processing of steps S109, S110, S111, in step S112, the CPU 5 generates the sound signal having the pitch based on the performance data acquired from the performance operator 1 or the storage device 10 for each timbre corresponding to the timbre sections set to be valid in the current performance. At this time, the CPU 5 reflects the effect settings that are set to be valid. Here, even if the generated CC message is transmitted to the external device 2000 through the MIDI I/F 11, the CPU 5 controls the generation of the sound signal generated by the sound signal generation unit in parallel with the transmission of the CC message. At this time, the CPU 5 controls the generation of the sound signal generated by the sound signal generation unit based on the setting contents of the setting unit designated as valid and the CC message generated for the setting unit designated as valid.

In step S113, the CPU 5 generates a sound by outputting the sound signal generated in step S112 to the sound system 15. In step S114, the CPU 5 executes other processing, and then returns the processing to step S102. In the other processing, for example, if there is an operation of the user indicating an end instruction, the CPU 5 ends the sound signal control processing as shown in FIG. 8.

According to the present embodiment, since the layered sound production by parallel use of external sound source is realized, a performance can be improved. In the Invert mode, the CC message generated for the timbre section designated as valid is not transmitted to the external device 2000, and the CC message generated for the timbre section designated as invalid is transmitted to the external device 2000. Therefore, it is possible to use the parameter operator of the timbre section designated as valid to control the internal sound source, and use the parameter operator of the timbre section designated as invalid to control the external sound source. In this way, since the unused parameter operator of the timbre section for the internal sound source is effectively used for the external sound source, it is not necessary to provide a dedicated parameter operator to control the external sound source. Therefore, complication of a configuration for performing layered sound production and an increase in cost can be avoided. In particular, whether the parameter operator is used to control the internal sound source or to control the external sound source can be easily switched during a performance by operating the switches 31, 51, 71, so that the operability is improved. Therefore, according to the present embodiment, the operability can be improved, and the operator can be effectively used.

In addition, since the timbre section ON/OFF switches (31, 51, 71) are provided, which have the function of setting the timbre of each timbre section and designating the validity/invalidity of each timbre section, the performer can easily remember the operation.

As for message reception, since the control mode can be changed by operating the switches 31, 51, 71, the operability is improved.

In the present embodiment, when message transmission and reception are determined to be performed, the CPU 5 receives the CC message transmitted from the external device 2000. However, a switching unit configured to switch a communication direction may also be provided. For example, the dial 21 and the menu button 24 in the main section 20 can be used as the switching unit. If the communication direction is a "transmission direction", the CPU 5 proceeds to step S105 after step S104. Meanwhile, if the communication direction is a "reception direction", the CPU 5 executes reception processing after step S104, and then advances the processing to step S112. In this reception processing, the processing is executed in accordance with the control mode. That is, in the ON mode, the CC message corresponding to the timbre section designated as valid is received from the external device 2000 through the MIDI I/F 11, and the CC message corresponding to the timbre section designated as invalid is not received from the external device 2000 through the MIDI I/F 11. In the OFF mode, the CC message from the external device 2000 is not received regardless of the valid/invalid designation of each timbre section. In the Invert mode, the CC message corresponding to the timbre section designated as valid is not received from the external device 2000 through the MIDI I/F 11, and the CC message corresponding to the timbre section designated as invalid is received from the external device 2000 through the MIDI I/F 11.

The designation units 231, 251, 271 are not necessarily included in the setting units 230, 250, 270. An operator configured to perform the function of the designation units 231, 251, 271 may be provided separately from the timbre sections.

A notification unit, such as a lamp, configured to indicate valid/invalid states of each of the timbre sections 30, 50, 70, may be provided. A notification unit, such as a lamp, configured to indicate the current control mode, may be provided. Further, a notification unit, such as a lamp, configured to notify the timbre section to which the CC message is to be transmitted to the outside in the Invert mode, may be provided. Modes of the notification are not limited, and lighting, extinguishing, or blinking of the lamp may be adopted as appropriate.

Although the CC message is exemplified as a message to be transmitted to the outside in the Invert mode, an exclusive message may also be included.

The configuration is not limited to the example shown in FIG. 6, and a configuration, in which the message transmission and reception are determined (to transmit and receive) regardless of the valid/invalid designation of each timbre section when the control mode is the ON mode, may be employed.

Although the number of the common effects exemplified in the present embodiment is two, the present invention is not limited thereto, and the number thereof may be one or three or more. The type and the number of the insertion effects unique to each timbre section are not limited to those exemplified.

Although the present invention is described in detail based on a preferred embodiment thereof, the present invention is not limited thereto, and various modes without departing from the spirit of the present invention are also included in the present invention.

A storage medium storing a control program represented by the software for achieving the present invention may be read out to the sound control device so as to achieve the same effects as those of the present invention. In this case, a program code read out from the storage medium realizes the novel functions of the present invention, and a non-transitory computer-readable recording medium storing the program code constitutes the present invention. The program code may be supplied via a transmission medium or the like. In this case, the program code constitutes the present invention. In addition to the ROM, a floppy disk, a hard disk, an optical disk, a magneto-optical disk, a CD-ROM, a CD-R, a magnetic tape, a nonvolatile memory card, or the like may be used as the storage medium in these cases. The non-transitory computer-readable recording medium includes a recording medium that retains a program for a certain period of time, such as a volatile memory (for example, a dynamic random access memory (DRAM)) inside a computer system serving as a server or a client when the program is transmitted via a network such as the Internet or a communication line such as a telephone line.

What is claimed is:

1. A sound control device, comprising:

a plurality of setting interfaces, each including a parameter operator configured to set a sound parameter corresponding to a set timbre;

a communication interface configured to perform message transmission and reception with an external MIDI sound source, the message being a control change message of an MIDI standard;

a generator configured to generate the control change message in response to an operation on the parameter operators of the plurality of setting interfaces;

a designator configured to designate validity or invalidity of a sound signal for each of the plurality of setting interfaces;

a mode selector configured to select one of a plurality of control modes of the communication interface; and a controller configured to control such that, when a first mode is selected by the mode selector:

the control change message generated by the generator for a setting interface which is designated as valid among the plurality of setting interfaces is not transmitted through the communication interface; and the control change message generated by the generator for a setting interface which is designated as invalid among the plurality of setting interfaces is transmitted through the communication interface.

2. The sound control device according to claim 1, wherein the controller controls such that, when a second mode is selected by the mode selector:

the control change message generated by the generator for the setting interface which is designated as valid among the plurality of setting interfaces is transmitted through the communication interface; and the control change message generated by the generator for the setting interface which is designated as invalid among the plurality of setting interfaces is not transmitted through the communication interface, and when a third mode is selected by the mode selector, any control change message generated by the generator is not transmitted through the communication interface regardless of valid or invalid designation of the plurality of setting interfaces.

3. The sound control device according to claim 2, further comprising:

a switch configured to switch a communication direction of the communication interface between a transmission direction and a reception direction, wherein the controller controls such that, in a state where the communication direction is switched to the reception direction by the switch, when the second mode is selected:

the control change message corresponding to the setting interface which is designated as valid among the plurality of setting interfaces is received; and the control change message corresponding to the setting interface which is designated as invalid among the plurality of setting interfaces is not received, when the third mode is selected, the control change message is not received through the communication interface regardless of the valid or invalid designation of the plurality of setting interfaces, and when the first mode is selected:

the control change message corresponding to the setting interface which is designated as valid among the plurality of setting interfaces is not received through the communication interface; and the control change message corresponding to the setting interface which is designated as invalid among the plurality of setting interfaces is received through the communication interface.

4. The sound control device according to claim 1, further comprising:

a sound signal generator configured to generate the sound signal based on performance information, wherein in one mode of the plurality of control modes where the control change message generated by the generator is transmitted through the communication interface, the controller controls, in parallel with the transmission of the generated control change message, generation of the sound signal generated by the sound signal generator based on a setting content of the setting interface which is designated as valid and the control change message generated for the setting interface which is designated as valid.

5. The sound control device according to claim 1, wherein the sound parameter includes at least one of volume and effect.

6. The sound control device according to claim 1, wherein each of the plurality of setting interfaces includes a timbre setting function.

7. The sound control device according to claim 1, further comprising:

a switch configured to switch a communication direction of the communication interface between a transmission direction and a reception direction, wherein the controller is configured such that, when the first mode is selected:

the control change message corresponding to the setting interface which is designated as valid among the plurality of setting interfaces is not received through the communication interface; and the control change message corresponding to the setting interface which is designated as invalid among the plurality of setting interfaces is received through the communication interface.

8. The sound control device according to claim 1, wherein when a second mode is selected by the mode selector, the controller transmits the control message for each operation of the parameter operator of the plurality of setting interfaces generated by the generator through the communication interface regardless of valid or invalid designation of the plurality of setting interfaces, and when a third mode is selected by the mode selector, any control change message generated by the generator is not transmitted through the communication interface regardless of the valid or invalid designation of the plurality of setting interfaces.

9. The sound control device according to claim 1, wherein each of the plurality of setting interfaces includes the designator.

10. A method of controlling a sound control device, wherein the sound control device includes a plurality of setting interfaces each including a parameter operator configured to set a sound parameter corresponding to a set timbre, and a communication interface configured to perform message transmission and reception with an external MIDI sound source, the message being a control change message of an MIDI standard, the method comprises:

generating the control change message in response to an operation on the parameter operators of the plurality of setting interfaces;

designating validity or invalidity of generating a sound signal for each of the plurality of setting interfaces based on a user operation;

selecting one of a plurality of control modes of the communication interface based on the user operation; and controlling such that, when a first mode among the plurality of control modes is selected:

the control change message generated for a setting interface which is designated as valid among the plurality of setting interfaces is not transmitted through the communication interface; and the control change message generated for a setting interface which is designated as invalid among the plurality of setting interfaces is transmitted through the communication interface.

11. The method according to claim 10, wherein the control is performed such that, when a second mode among the plurality of control modes is selected:

the control change message generated for the setting interface which is designated as valid among the plurality of setting interfaces is transmitted through the communication interface; and the control change message generated for the setting interface which is designated as invalid among the plurality of setting interfaces is not transmitted through the communication interface, and when a third mode among the plurality of control modes is selected, any control change message is not transmitted through the communication interface regardless of valid or invalid designation of the plurality of setting interfaces.

12. The method according to claim 11, wherein the control is performed such that, in a state where a communication direction of the communication interface is switched to a reception direction among a transmission direction and the reception direction, when the second mode is selected:

the control change message corresponding to the setting interface which is designated as valid among the plurality of setting interfaces is received through the communication interface; and the control change message corresponding to the setting interface which is designated as invalid among the plurality of setting interfaces is not received through the communication interface, when the third mode is selected, the control change message is not received through the communication interface regardless of valid or invalid designation of the plurality of setting interfaces, and when the first mode is selected:

the control change message corresponding to the setting interface which is designated as valid among the plurality of setting interfaces is not received through the communication interface; and the control change message corresponding to the setting interface which is designated as invalid among the plurality of setting interfaces is received through the communication interface.

13. The method according to claim 10, wherein when the sound signal is generated based on performance information, in plurality of control modes where the generated control change message is transmitted through the communication interface, the generation of the sound signal is controlled in parallel with the transmission of the generated control change message based on a setting content of the setting interface which is designated as valid and the control change message generated for the setting interface which is designated as valid.

14. The method according to claim 10, wherein the sound parameter includes at least one of volume and effect.

15. The method according to claim 10, wherein each of the plurality of setting interfaces includes a timbre setting function.

16. The method according to claim 10, wherein the control is performed such that, in state where a communication direction of the communication interface is switched to a reception direction among a transmission direction and the reception direction, when the first mode is selected:

the control change message corresponding to the setting interface which is designated as valid among the plurality of setting interfaces is not received through the communication interface; and the control change message corresponding to the setting interface which is designated as invalid among the plurality of setting interfaces is received through the communication interface.

17. The method according to claim 10, wherein the control is performed such that, when a second mode among the plurality of control modes is selected, the control message for each operation of the parameter operator of the plurality of setting interfaces is transmitted through the communication interface regardless of valid or invalid designation of the plurality of setting interfaces, and when a third mode among the plurality of control modes is selected, any generated control change message is not transmitted through the communication interface regardless of the valid or invalid designation of the plurality of setting interfaces.

18. A non-transitory computer-readable storage medium in which a program is stored, the program configured to execute, on a computer, a method of controlling a sound control device, wherein the sound control device includes a plurality of setting interfaces each including a parameter operator configured to set a sound parameter corresponding to a set timbre, and a communication interface configured to perform message transmission and reception with an external MIDI sound source, the message being a control change message of an MIDI standard, the method of controlling the sound control device includes:

generating the control change message in response to an operation on the parameter operators of the plurality of setting interfaces;

designating validity or invalidity of generating a sound signal for each of the plurality of setting interfaces based on a user operation;

selecting one of a plurality of control modes of the communication interface based on the user operation; and controlling such that, when a first mode among the plurality of control modes is selected:

the control change message generated for a setting interface which is designated as valid among the plurality of setting interfaces is not transmitted through the communication interface; and the control change message generated for a setting interface which is designated as invalid among the plurality of setting interfaces is transmitted through the communication interface.

* * * * *